US006768270B2

(12) United States Patent
Chae

(10) Patent No.: US 6,768,270 B2
(45) Date of Patent: Jul. 27, 2004

(54) AC-TYPE PLASMA DISPLAY PANEL HAVING ENERGY RECOVERY UNIT IN SUSTAIN DRIVER

(75) Inventor: Gyun Chae, Gyeonggi-Do (KR)

(73) Assignee: Ultra Plasma Display Corporation, Gyeonggi-Do (KR)

( * ) Notice: Subject to any disclaimer, the term of this patent is extended or adjusted under 35 U.S.C. 154(b) by 140 days.

(21) Appl. No.: 10/186,816

(22) Filed: Jun. 28, 2002

(65) Prior Publication Data

US 2003/0006716 A1 Jan. 9, 2003

(30) Foreign Application Priority Data

Jul. 3, 2001 (KR) ..... 10-2001-0039476

(51) Int. Cl.[7] ..... G09G 3/28
(52) U.S. Cl. ..... 315/169.3; 315/169.1; 345/60
(58) Field of Search ..... 315/169.1, 169.3, 315/169.4; 345/60, 68, 76, 204, 213

(56) References Cited

U.S. PATENT DOCUMENTS 5,670,974 A * 9/1997 Ohba et al. ..... 345/60
6,538,627 B1 * 3/2003 Whang et al. ..... 315/169.3
6,583,575 B2 * 6/2003 Roh et al. ..... 315/169.1

FOREIGN PATENT DOCUMENTS

JP 09-325735 12/1997

* cited by examiner

*Primary Examiner*—Don Wong
*Assistant Examiner*—Jimmy T Vu
(74) *Attorney, Agent, or Firm*—Blakely, Sokoloff, Taylor & Zafman

(57) ABSTRACT

A plasma display panel(PDP) including: a panel capacitor representing panels of the PDP; a driving unit for driving the panel capacitor to a sustain voltage and ground voltage; and an energy recovery unit for recovering and supplying energy together with the driving unit, wherein the energy recovery unit includes, a first inductor for forming a ¼ cycle resonance unit with the panel capacitor when the panel capacitor is charged; a second inductor for forming a ¼ cycle resonance unit with the panel capacitor when the panel capacitor is discharged; and an external capacitor for supplying an energy to the ¼ cycle resonance unit and storing recovered energy.

20 Claims, 7 Drawing Sheets

AC-TYPE PLASMA DISPLAY PANEL HAVING ENERGY RECOVERY UNIT IN SUSTAIN DRIVER

FIELD OF THE INVENTION

The present invention relates to a plasma display panel technology; and, more particularly, to an energy recovery unit of a sustain driver in an AC-type plasma display panel.

DESCRIPTION OF RELATED ART

A plasma display panel(PDP) is a device for displaying a picture and it has been known as a gas discharge display device. Discharge gases, such as Kr and Xe, are filled up between upper and lower panels of the plasma display panel, and an ultraviolet ray generated through the gas discharge exciting red, green and yellow fluorescents, which are formed at least one of the upper and lower panels thereby to generate visible lights.

The PDP is classified into a DC type and an AC type. In the DC type PDP, electrodes for applying voltage to the panel is exposed directly to the discharge gas so that a current directly flows between electrodes in order to form the plasma. Therefore, it is advantageous that the structure is relatively simple. On the other hand, it has disadvantage that the external resistor has to be placed to limit the current. In the AC type PDP, the electrodes are covered with the dielectric substances so that the electrodes are not exposed directly to the discharge gas in order to flow a displacement current. The AC type PDP has longer life span, compared with the DC type PDP, because the electrodes of the AC type PDP can be protected from an ion impact by covering the electrodes with the dielectric substances to limit the current naturally. The AC type PDP can be classified into an opposite discharge type and a surface discharge type. The opposite discharge type has the disadvantage that the life span is shortened by the degradation of the fluorescent substances owing to the ion impact. In the surface discharge type, on the other hand, the discharge is generated near the front panel opposite to the fluorescent substances in order to minimize the degradation of the fluorescent substances, therefore, the surface discharge type is adopted to most of the PDP manufacturing processes.

In the AC type PDP, the high voltage has to be applied continuously and alternately between the sustain electrodes (X electrode and Y electrode) in the discharge cell during the operation of the PDP. Therefore, the dielectric substances are spread over the sustain electrodes so that a panel capacitor exists between X electrode and Y electrode.

In order to alternatively apply the positive and negative high voltage between the sustain electrodes during the operation of the PDP, the charge and discharge operations of the panel capacitor has to be performed. However, the power is consumed considerably by the panel capacitor during the charge and discharge operations, and the power loss problem of a panel drive circuit is generated because the capacitance of the panel capacitor is increased in proportion to the size of the panel.

In order to solve the power loss problems in the panel drive circuit, an energy recovery unit is adopted to the conventional panel drive circuit. In the energy recovery unit, an inductor for forming a LC resonance circuit with the panel capacitor is used to recover the energy loss during the discharge of the panel capacitor. The energy is stored in the inductor through the recovery, and the stored energy is used during the next charge operation of the panel capacitor to reduce the power loss.

A conventional circuit structure of a Weber-type sustain driver in the PDP having an energy recovery unit is shown in FIG. 1.

Referring to FIG. 1, a sustain driver, in the PDP having the energy recovery unit, includes a first and second sustain drivers 100 and 200 which are connected across a panel capacitor Cp.

The first sustain driver 100 includes a driving unit 12 and an energy recovery unit 10. The driving unit 12 drives the panel capacitor Cp to a sustain voltage Vsus or the ground voltage. The energy recovery unit 10 recoveries the energy loss caused during the discharge operation of the panel capacitor Cp and provides the recovered energy to the panel capacitor Cp during the next charge operation.

The first and second sustain drivers 100 and 200 have symmetrical configuration across the panel capacitor Cp. During the charge and discharge operations, the voltage Vp of the panel capacitor Cp is swung to positive and negative voltage by the first and second sustain drivers 100 and 200 operating alternatively with each other. Therefore, the detailed diagram of the second sustain driver 200 is not shown in FIG. 1, because the second sustain driver 200 has the same structure with the first sustain driver 100.

The driving unit 12 of the first sustain driver 100 includes a first switch S1 and a second switch S2. The first switch is connected to a power source supplying the sustain voltage Vsus and the panel capacitor Cp and transfers the sustain voltage to the panel capacitor. The second switch S2 is connected the ground and the panel capacitor Cp and transfers the ground voltage to the panel capacitor.

The first energy recovery unit 10 in the first sustain driver 100 includes an inductor Lr, an external capacitor Ce, third and fourth switches S3 and S4, and first and second diodes D1 and D2.

The inductor Lr is connected to the panel capacitor Cp for operating the panel capacitor Cp with a half resonance. The external Capacitor Ce stores the energy recovered by the resonance operation of the inductor Lr and the panel capacitor Cp. The third and fourth switches S3 and S4, coupling in parallel, are connected to the external capacitor Ce for switching an energy recovery path. The first and second diodes D1 and D2, coupled in parallel and to reversal direction with each other, are respectively connected to the third and fourth switches S3 and S4. The inductor Lr is connected to the first and second diodes D1 and D2 in order to prevent a reverse of resonance current IL.

Each switch S1, S2, S3 and S4 can be formed with a metal oxide semiconductor field effect transistor (MOSFET), a reversal and parallel connected diode or an insulate gate bipolar transistor (IGBT).

A resonance frequency ($f_0$) of a L-C series resonance circuit can be described as formula 1:

$$f_0 = \tfrac{1}{2}\,(LC)^{1/2}. \qquad \text{[Formula 1]}$$

A resonance cycle (T) can be described as formula 2:

$$T = 2\,(LC)^{1/2}. \qquad \text{[Formula 2]}$$

A resonance current has a period of 2 $(LC)^{1/2}$, and the maximum resonance current is generated in a condition of a half resonance, $\pi\,(LC)^{1/2}$.

FIG. 2 shows waveforms of the sustain driver having the energy recovery unit shown in FIG. 1. In FIG. 2, a waveform of the voltage Vp of the panel capacitor Cp, a waveform of the resonance current IL, and each waveform Vg(S1), Vg(S2), Vg(S3) and Vg(S4) of switch S1, S2, S3 and S4, are shown.

Referring to FIG. 2, the first sustain driver 100 is operated by setting four periods T1 to T4 as one cycle. The energy of Vsus/2, recovered from the panel capacitor Cp in the previous cycle, is stored in the external capacitor Ce of the first energy recovery unit 10.

An initial condition reflects the operation of the second sustain driver 200. In the period of T0, the second switch S2 in the driving unit 12 of the first sustain driver 100 is turned on and a pull-down switch (not shown) in a driving unit of the second sustain driver 200 is turned on to form a closed-loop. At this time, the voltage Vp of the panel capacitor Cp is the ground voltage 0V and the resonance current IL does not flows.

In the first period of T1, a current path is formed between the external capacitor Ce and the panel capacitor Cp by turning on the switch S3. At this time, the resonance current IL is formed by the resonance operation of the inductor Lr and the panel capacitor Cp so that the voltage Vp of the panel capacitor Cp increases up to the sustain voltage Vsus.

In the second period of T2, the voltage Vp of the panel capacitor Cp is sustained to the sustain voltage Vsus by turning on the switch S1. The switch S3, however, should be turned on until a ½ resonance cycle is completed, and the switch 3 can be either turned on or turned off after the ½ resonance cycle.

In the third period of T3, the current path is formed between the panel capacitor Cp and the external capacitor Ce by turning off the switch S1 and turning on the switch S2. The energy stored in the panel capacitor Cp by the resonance operation of the inductor Lr and the panel capacitor Cp is recovered to the external capacitor Ce.

In the fourth period of T4, the voltage Vp of the panel capacitor Cp is sustained to the ground voltage 0V by turning on the switch S2. The switch S4, however, should be turned on until a ½ resonance cycle is completed, and the switch 4 can be either turned on or turned after the ½ resonance cycle. Further, a closed-loop is formed by turning on the pull-down switch (not shown) of the driving unit in the second sustain driver 200 during the operation of four periods T1 to T4 in the first sustain driver 100.

Thereafter, the operations of four periods, T1 to T4, are performed in the second sustain driver 200. At this time, the voltage Vp of the panel capacitor Cp becomes the negative voltage.

The power loss can be reduced by the conventional PDP comprising the energy recovery unit, that is, the energy stored in the external capacitor Ce, and the panel capacitor Cp is charged and discharged with ½ resonance of the inductor IL and the panel capacitor Cp in the sustain drivers.

In addition, the voltage Vp of the panel capacitor increases to the sustain voltage Vsus by the resonance current IL and the current transferred from the external capacitor Ce charged with Vsus/2 during the first period of T1. However, actually, a voltage drop Δ, i.e. an energy loss, is generated by a resistance of connection lines and by parasite resistances of devices in the PDP for the charging and discharging operations. Therefore, the efficiency of the energy recovery and the driving characteristic of the PDP are degraded.

SUMMARY OF THE INVENTION

It is, therefore, an object of the present invention to provide an energy recovery unit of sustain driver in AC-type plasma display panel (PDP) capable of preventing lowering of an energy recovery efficiency owing to the parasite resistance and improving a drive characteristic of the PDP.

In accordance with an aspect of the present invention, there is provided a plasma display panel (PDP) comprising: a panel capacitor representing panels of the PDP; a driving unit for driving the panel capacitor to a sustain voltage and ground voltage; and an energy recovery unit for recovering and supplying energy together with the driving unit, wherein the energy recovery unit includes, a first inductor for forming a ¼ cycle resonance unit with the panel capacitor when the panel capacitor is charged; a second inductor for forming a ¼ cycle resonance unit with the panel capacitor when the panel capacitor is discharged; and an external capacitor for supplying an energy to the ¼ cycle resonance unit and storing recovered energy.

In accordance with another aspect of the present invention, there is provided a A plasma display panel (PDP) comprising: a panel capacitor representing panels of the PDP; a driving unit for driving the panel capacitor to a sustain voltage and ground voltage; and an energy recovery unit for recovering and supplying energy together with the driving unit, wherein the energy recovery unit includes, a first inductor for forming a ¼ cycle resonance unit with the panel capacitor when the panel capacitor is charged; a second inductor for forming a ¼ cycle resonance unit with the panel capacitor when the panel capacitor is discharged; and an external capacitor, of which voltage level is the sustain voltage, for supplying an energy to the ¼ cycle resonance unit and storing recovered energy.

In the present invention, a panel capacitor is charged and discharged with ¼ resonance of the panel capacitor and an inductor in an energy recovery unit, and the energy is stored in an external capacitor. Therefore, the charge and discharge operations of the panel capacitor can be carried out, sufficiently, regardless of an amount of a parasite loss, and the effect of a panel discharge generated during a recovery period can be reduced. For achieving the above-mentioned advantage, the energy recovery unit of the present invention further comprises a first inductor and a second inductor. The first inductor generates ¼ resonance with the panel capacitor in case of charging the panel capacitor, and the second inductor generates ¼ resonance with the panel capacitor in case of discharging the panel capacitor and external capacitor. In charge and discharge periods of a panel capacitor, a voltage Vsus is provided to a LC serial resonance circuit, which is comprised of the panel capacitor and two inductors, thereby to recover remnant energy.

BRIEF DESCRIPTION OF THE DRAWINGS

Other objects and aspects of the invention will become apparent from the following description of the embodiments with reference to the accompanying drawings, in which.

DETAILED DESCRIPTION OF THE INVENTION

Hereinafter, a semiconductor capacitor according to the present invention will be described in detail referring to the accompanying drawings.

Figure 1:
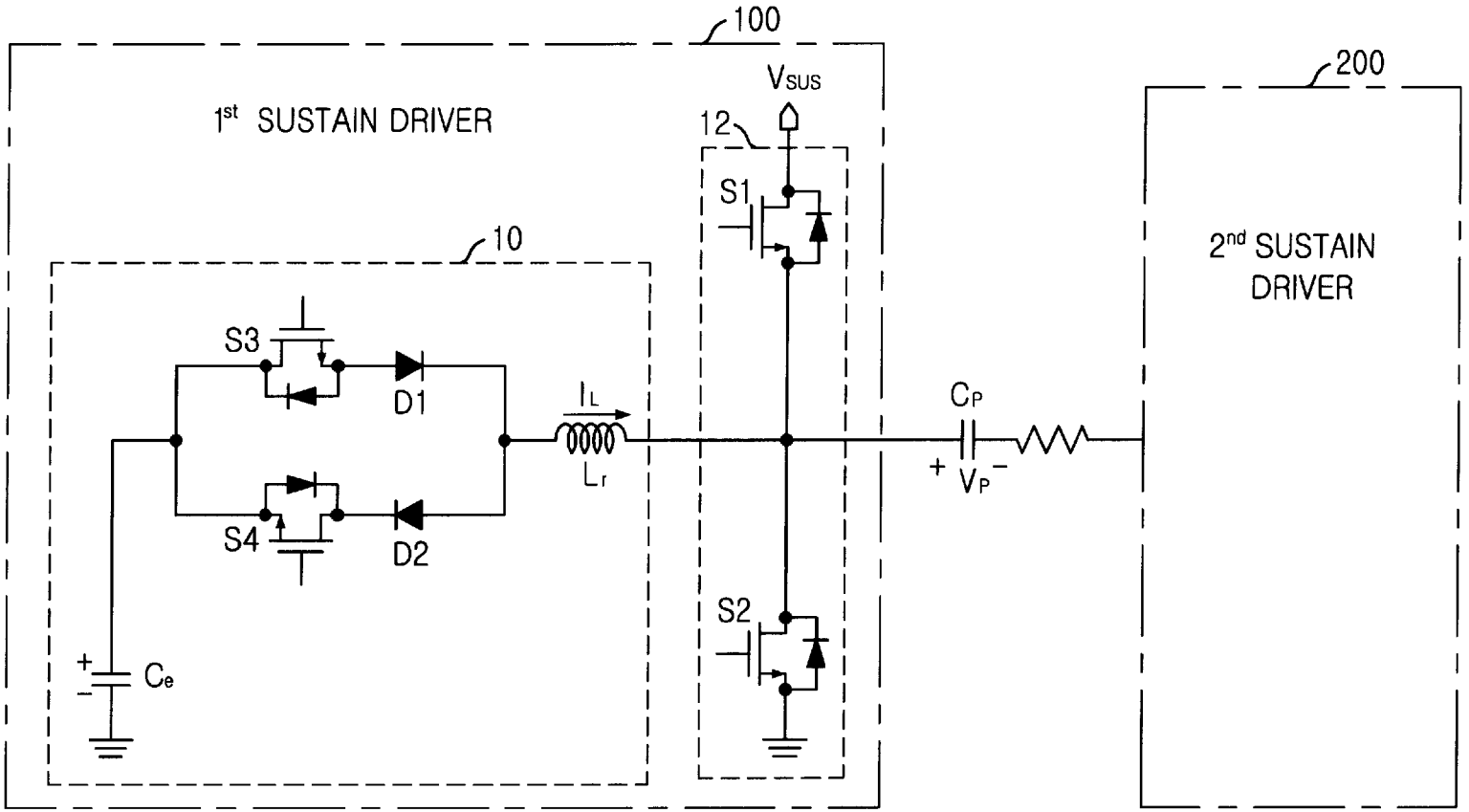
FIG. 1 (PRIOR ART)
FIG. 1 is a circuit diagram showing a conventional Weber-type sustain driver of the plasma display panel (PDP) having an energy recovery unit.
Figure 2:
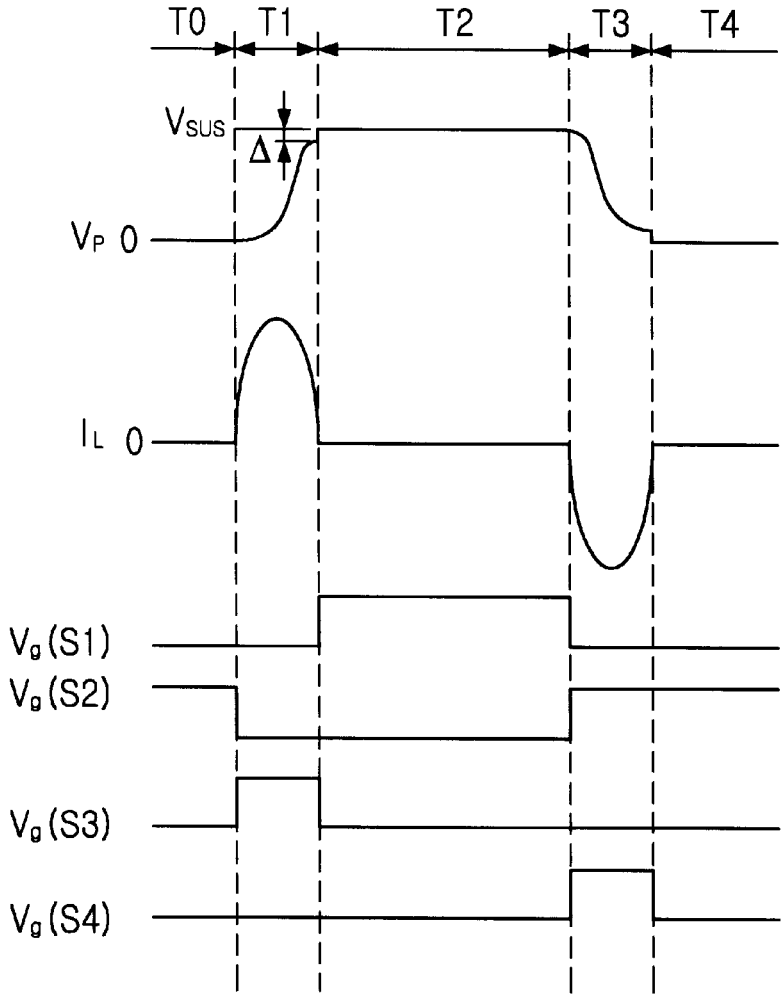
FIG. 2 (PRIOR ART)
FIG. 2 is a diagram showing waveforms of operating the sustain driver in the PDP shown in FIG. 1.
Figure 3:
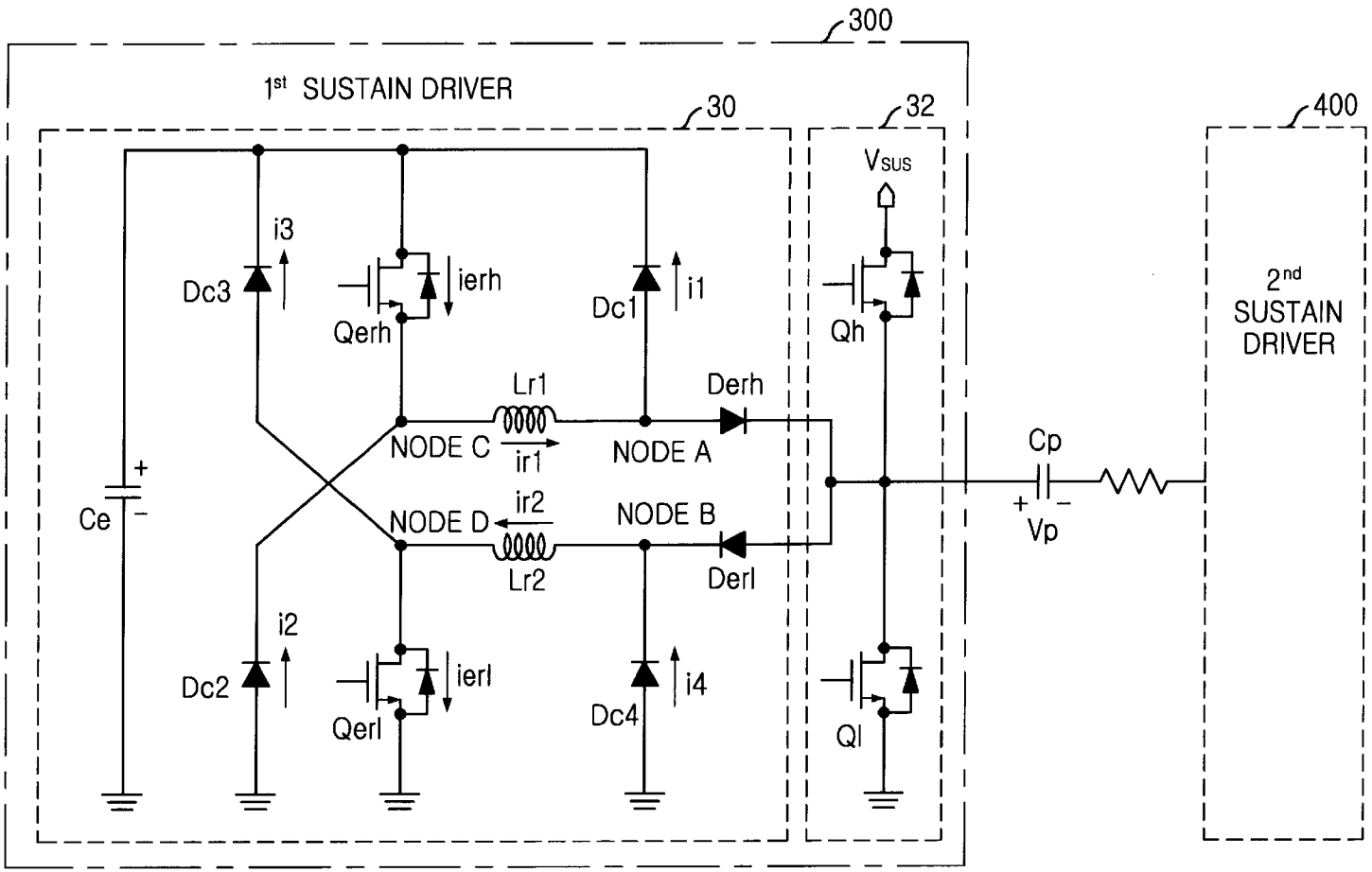
FIG. 3 is a circuit diagram showing sustain drivers of a first plasma display panel (PDP) having an energy recovery unit in accordance with an embodiment of the present invention.

FIG. 3 is a circuit diagram showing sustain drivers in a first PDP having the energy recovery unit in accordance with an embodiment of the present invention.

Referring to FIG. 3, the sustain drivers in the PDP having the energy recovery unit are a first sustain driver 300 and a second sustain driver 400 which are connected to the panel capacitor Cp representing the panel.

The first sustain driver 300 includes a driving unit 32 for driving the panel capacitor Cp to the sustain voltage Vsus or the ground voltage and an energy recovery unit 30 for recovering the energy loss during the charge and discharge operations of the panel capacitor Cp and providing the recovered energy to the panel capacitor Cp.

The driving unit 32 includes a pull-up switch Qh connected to a power source supplying the sustain voltage Vsus and the panel capacitor Cp for driving the panel capacitor Cp to the sustain voltage Vsus and a pull-down switch Ql connected to the ground and the panel capacitor Cp for driving the panel capacitor Cp to the ground and providing a closed loop in case of driving the second sustain driver 400.

The energy recovery unit 30 includes a charge path diode Derh, a discharge path diode Derl, a first inductor Lr1, a second inductor Lr2, an external capacitor Ce, a first diode Dc1, a second diode Dc2, a third diode Dc3, a fourth diode Dc4, a first switch Qerh and a second switch Qerl. A cathode of the charge path diode Derh are connected to the panel capacitor Cp and an anode to a node A, respectively, for preventing backflow of the resonance current. The discharge path diode Der1 prevents backflow of the resonance current by providing an anode connected to the panel capacitor and a cathode connected to a node B. The first inductor Lr1 connected to nodes A and C and the second inductor Lr2 connected to nodes B and D generate ¼ resonance with the panel capacitor Cp, respectively. The first and the second inductors Lr1 and Lr2 may have the same inductance. A first electrode of the external capacitor Ce is connected to the ground. The external capacitor provides the sustain voltage Vsus to the LC serial resonance circuit in case of charging the panel capacitor Cp and recovers energy in case of discharging the panel capacitor Cp. The LC serial resonance circuit is comprised of the panel capacitor Cp and the first and the second inductors Lr1 and Lr2. The anode and the cathode of the first diode Dc1 are connected to the node A and a second electrode of the external capacitor Ce, respectively. The cathode and the anode of the second diode Dc2 are connected to the node C and the ground, respectively. The cathode and the anode of the third diode Dc3 are connected to the node D and the second electrode of the external capacitor Ce, respectively. The cathode and the anode of the fourth diode Dc4 are connected to the node B and the ground, respectively. The first switch Qerh is connected to the node C and the second electrode of the external capacitor Ce, and the second switch Qerl is connected to node D and the ground. Each switch Qerh, Qerl, Qh and Ql can be formed with a metal oxide semiconductor field effect transistor (MOSFET), a reversal and parallel connected diode or an insulating gate bipolar transistor (IGBT).

Figure 4A:
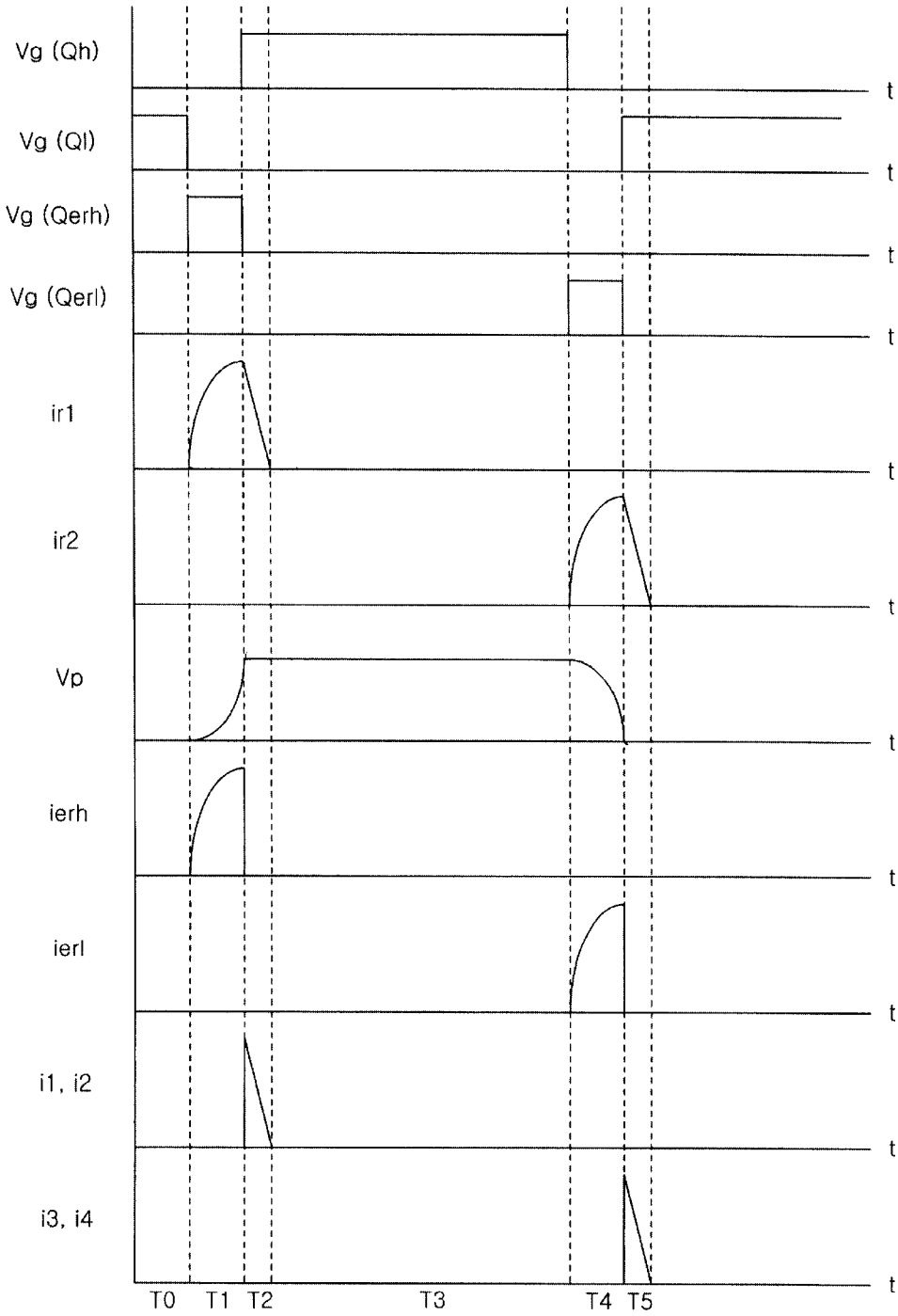
FIGS. 4A to 4C are diagrams showing waveforms of operating the sustain driver in the PDP shown in FIG. 3.

FIG. 4A is first waveforms of the sustain driver of the PDP having the energy recovery unit shown in FIG. 3. In FIG. 4A, each wave form Vg(Qh), Vg(Ql), Vg(Qerh) and Vg(Qerl) of each switch Qh, Ql, Qerh and Qerl, each waveform ir1 and ir2 of inductor currents flowing to the first and second inductor Lr1 and Lr2, respectively, a waveform of the voltage Vp of the panel capacitor Cp, each waveform ierh and ierl of current flowing the first and second switch Qerh and Qerl, respectively, and each current i1 to i4 of four diodes Dc1 to Dc4, in case of setting up an interval of turn-on of the first switch Qerh and the second switch Qerl as much as a ¼ resonance cycle of the panel capacitor Cp and inductors Lr1 and Lr2 in the energy recovery unit 30, when the panel capacitor Cp is charged and discharged.

Referring to FIG. 4A, the driving unit 32 and the energy recovery unit 30 are operated by setting five periods (T1 to T5) as one cycle.

An operation of the second sustain driver 400 is reflected on the initial state of the driving unit 32 and the energy recovery unit circuit 30, that is, in the period of T0, the pull-down switch Ql of the driving unit 32 of the first sustain driver 300 is turned-on, and an energy recovered in a previous cycle is stored in the external capacitor Ce of the recovery circuit. At this time, the voltage Vp of the panel capacitor Cp is the ground voltage V0, and the inductor currents ir1 and ir2 are not flowed.

In the period of T1, the pull-down switch Ql of the driving unit 32 is turned-off and the first switch Qerh of the energy recovery unit 30 is turned-on to form a current path comprising the external capacitor Ce, the first switch Qerh, the first inductor Lr1, the charge path diode Derh biased to the forward and the panel capacitor Cp. The voltage of the one electrode of the panel capacitor Cp is increased to the voltage Vsus by the resonance current ir1 owing to the ¼ resonance of the first inductor Lr1 and the panel capacitor Cp. At this time, the current ir1 is increased up to maximum value, and the voltage Vp of the panel capacitor Cp is increased rapidly to the voltage Vsus with the characteristic of the ¼ resonance.

In the period of T2, the first switch Qerh is turned-off and the pull-up switch Qh of the driving unit 32 is turned-on to sustain the voltage Vp of the panel capacitor Cp to the voltage Vsus. At this time, the charge path diode Derh is turned-off if the first switch Qerh is turned-off, therefore, the resonance is not generated, and a current path, comprising the second diode Dc2, the first inductor Lr1, the first diode Dc1 and the external capacitor Ce, is formed to recover and store energy in the external capacitor Ce. In the period of T2, the current ir1 is decreased to 0, rapidly and linearly.

In the period of T3, state of each switch is sustained as the period of T2 in order to sustain the voltage Vp of the panel capacitor Cp to the voltage Vsus.

In the period of T4, the pull-up switch Qh in the driving unit 32 is turned-off and the second switch Qerl in the energy recovery unit 30 is turned-on to form a current path comprising the panel capacitor Cp, the discharge path diode Derl biased to the forward, the second inductor Lr2 and the second switch Qerl, and the voltage of the one electrode of the panel capacitor Cp is discharge to the ground voltage by the resonance current ir2 owing to the ¼ resonance of the second inductor Lr2 and the panel capacitor Cp. At this time, the voltage Vp of the panel capacitor Cp is decreased rapidly to the ground voltage with the ¼ resonance of the second inductor Lr2 and the panel capacitor Cp.

In the period of T5, the second switch Qrl is turned-off and the pull-down switch Ql of the driving unit 32 is turned-on, therefore, the voltage Vp of the panel capacitor Cp is sustained to the ground voltage. At this time, the discharge path diode Derl is turned-off if the second switch Qerl is turned-off, therefore, the resonance is not generated, and a current path, comprising the fourth diode Dc4, a second inductor Lr2, a first diode Dc1 and the external capacitor Ce, is formed to recover and store energy in the external capacitor Ce. In the period of T5, the current ir2 is decreased to 0, rapidly and linearly. Thereafter, state of each switch is sustained in order to sustain the voltage Vp of the panel capacitor Cp to the ground voltage.

A pull-down switch (not shown) of the driving unit in the second sustain driver 400 is turned-on for the periods T1 to T5 in order to form a closed-loop. After the period of T5 is completed in the first sustain driver 300, the periods T1 to T5 are performed in the second sustain driver 400 as the same manner in first sustain driver 300.

As described above, the ¼ resonance of panel capacitor Cp and the inductors Lr1 and Lr2 in the energy recovery unit 30 is induced, therefore, it is possible to prevent distortion phenomena of the driving waveform caused by a voltage loss owing to the parasite resistance generated in the charge and discharge operations of the panel capacitor, so that the sustain voltage having a complete spherical waveform can be supplied to the panel capacitor and the driving characteristic of the PDP can be improved.

Figure 4B:
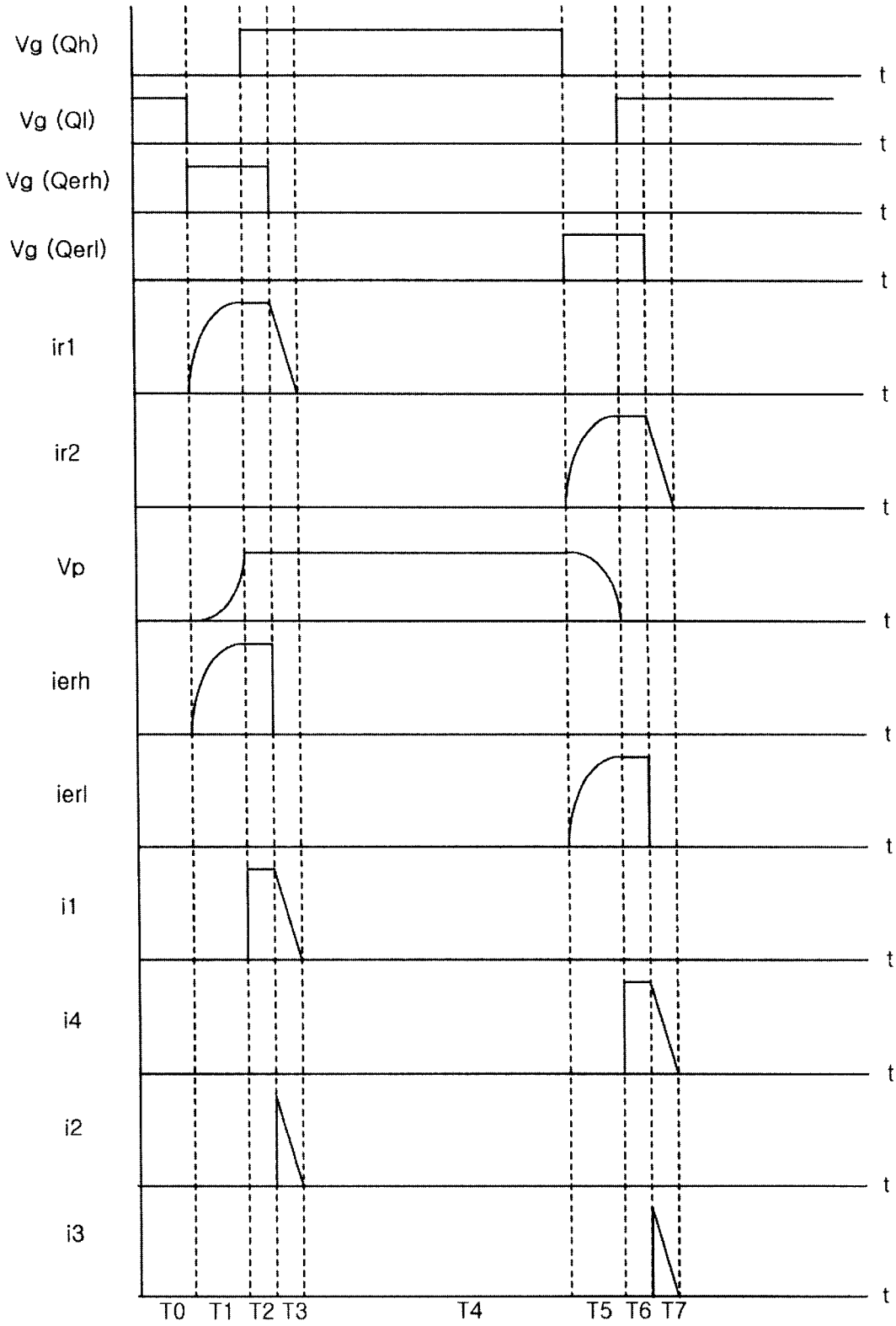

FIG. 4B is second waveforms of the sustain driver of the PDP having the energy recovery unit shown in FIG. 3, in case of setting up an interval of turn-on of the first switch Qerh and the second switch Qerl longer than the ¼ resonance cycle of the panel capacitor Cp and inductors Lr1 and Lr2 in the energy recovery unit 30, when the panel capacitor Cp is charged and discharged. That is, in the case shown in FIG. 4B, only the turn-on time of the first switch Qerh and the second switch Qerl are different from the case shown in FIG. 4A, and other switches are controlled as the same manner.

Referring to FIG. 4B, at the initial state, that is, in the period of T0, the pull-down switch Ql of the driving unit 32 in the first sustain driver 300 is turned-on. At this time, the voltage Vp of the panel capacitor Cp is the ground voltage V0, and the inductor currents ir1 and ir2 are not flowed.

In the period of T1, the pull-down switch Ql of the driving unit 32 is turned-off and the first switch Qerh of the energy recovery unit 30 is turned-on to form a current path comprising the external capacitor Ce, the first switch Qerh, the first inductor Lr1, the charge path diode Derh biased to the forward and the panel capacitor Cp, and the voltage of the one electrode of the panel capacitor Cp is increased to the voltage Vsus by the resonance current ir1 owing to the ¼ resonance of the first inductor Lr1 and the panel capacitor Cp. At this time, the current ir1 is increased up to maximum value, and the voltage Vp of the panel capacitor Cp is increased rapidly to the voltage Vsus for the characteristic of the ¼ resonance.

In the period of T2, the voltage Vp of the panel capacitor Cp is sustained to the voltage Vsus by turning-on the pull-up switch Qh of the driving unit 32. At this time, the first switch Qerh is turned on and the charge path diode Derh is biased to reverse, therefore, the inductor current ir1 freewheels with a constant value through the first switch, the first inductor Lr1 and the first diode Dc1.

In the period of T3, the first switch Qerh is turned-off, and a current path, comprising the second diode Dc2, the first inductor Lr1, the first diode Dc1 and the external capacitor Ce, is formed to recover and store energy in the external capacitor Ce. At this time, the charge path diode Derh is turned-off if the first switch Qerh is turned-off, therefore, the resonance is not generated, and the current ir1 is decreased to 0, rapidly and linearly.

In the period of T4, state of each switch is sustained as the period of T3 in order to sustain the voltage Vp of the panel capacitor Cp to the voltage Vsus.

In the period of T5, the pull-up switch Qh of the driving unit 32 is turned-off and the second switch Qerl of the energy recovery unit 30 is turned-on to form a current path comprising the panel capacitor Cp, the discharge path diode Derl biased to the forward, the second inductor Lr2 and the second switch Qerl, and the voltage of the one electrode of the panel capacitor Cp is discharge to the ground voltage by the resonance current ir2 owing to the ¼ resonance of the second inductor Lr2 and the panel capacitor Cp. At this time, the voltage Vp of the panel capacitor Cp is decreased rapidly to the ground voltage with the ¼ resonance of the second inductor Lr2 and the panel capacitor Cp.

In the period of T6, the pull-down switch Ql of the driving unit 32 is turned-on, and the voltage Vp of the panel capacitor Cp is sustained to the ground voltage. At this time, the fourth diode Dc4 is biased to forward, therefore, the inductor current ir2 flowing to the second inductor Lr2 freewheels with a constant value through the second switch and the fourth diode Dc4.

In the period of T7, the second switch Qerl is turned-off, and a current path, comprising the first diode Dc1 the external capacitor Ce, is formed to recover and store energy in the external capacitor Ce. At this time, the current ir2 is decreased to 0, rapidly and linearly. Thereafter, state of each switch is sustained in order to sustain the voltage Vp of the panel capacitor Cp to the ground voltage.

In the periods of T2 and T6, the inductor currents generated by the ¼ resonance freewheel with constant values. If the periods of T2 and T6 are extended, conduction losses in the first switch Qerh, the second switch Qerl, the first diode Dc1 and the second diode Dc2 are increased. Accordingly, it is advantageous to reduce the periods T2 and T6 as short as possible.

A pull-down switch (not shown) of the driving unit in the second sustain driver 400 is turned-on for the periods T1 to T7 in order to form a closed-loop.

After the period of T7 is completed in the first sustain driver 300, the periods T1 to T7 are performed in the second sustain driver 400 as the same manner in first sustain driver 300.

In second embodiment of the present invention, the ¼ resonance of panel capacitor Cp and the inductors Lr1 and Lr2 in the energy recovery unit 30 is induced, therefore, it is possible to prevent the generation of a voltage loss.

Figure 4C:
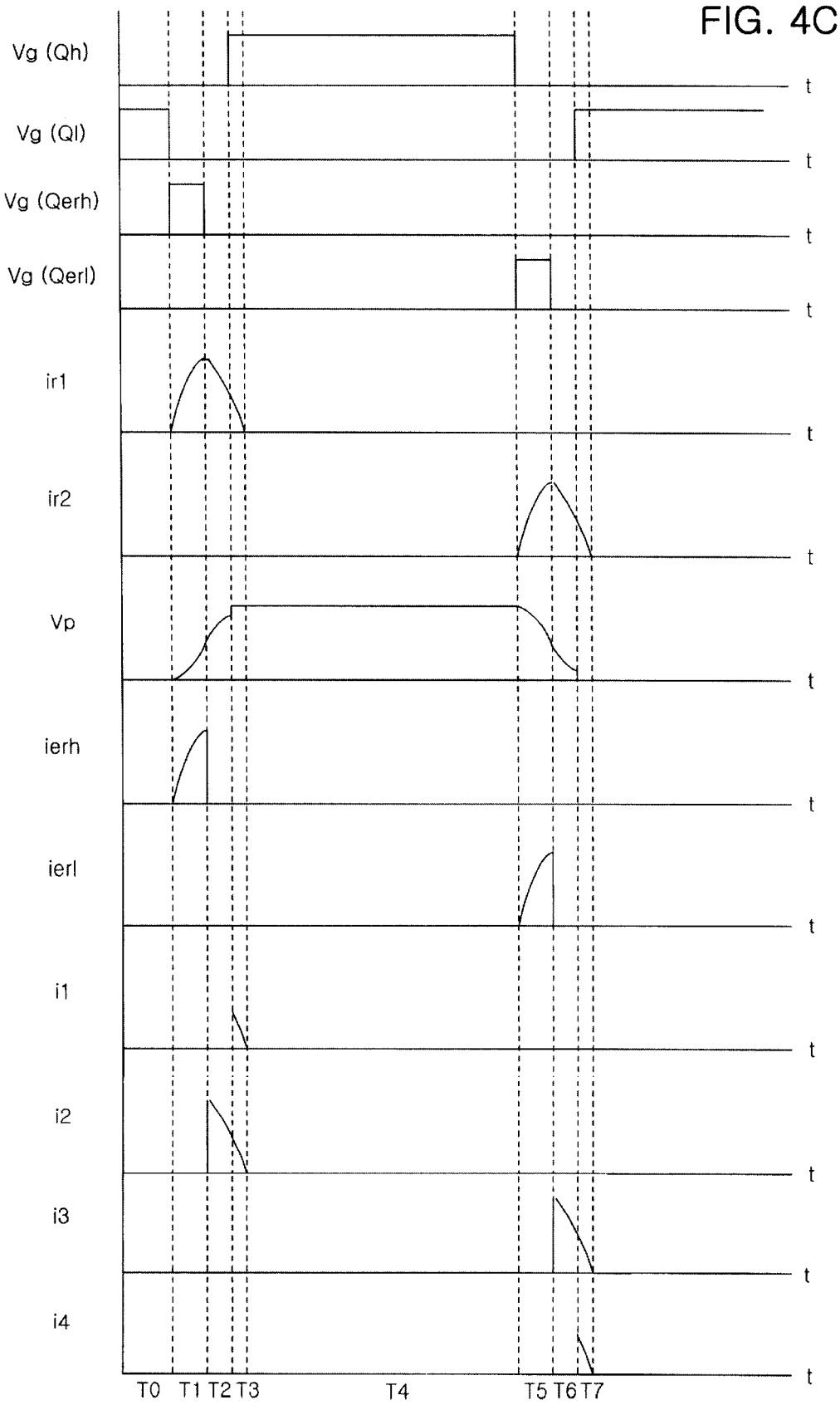

FIG. 4C is third waveforms of the sustain driver of the PDP having the energy recovery unit shown in FIG. 3, in case of setting up an interval of turn-on of the first switch Qerh and the second switch Qerl shorter than the ¼ resonance cycle of the panel capacitor Cp and inductors Lr1 and Lr2 in the energy recovery unit 30, when the panel capacitor Cp is charged and discharged. That is, in the case shown in FIG. 4C, only the turn-on time of the first switch Qerh and the second switch Qerl are different from the case shown in FIG. 4A, and other switches are controlled as the same manner.

Referring to FIG. 4C, at the initial state, that is, in the period of T0, the pull-down switch Ql of the driving unit 32 in the first sustain driver 300 is turned-on. At this time, the voltage Vp of the panel capacitor Cp is the ground voltage V0, and the inductor currents ir1 and ir2 are not flowed.

In the period of T1, the pull-down switch Ql of the driving unit 32 is turned-off and the first switch Qerh of the energy recovery unit 30 is turned-on to form a current path comprising the external capacitor Ce, the first switch Qerh, the first inductor Lr1, the charge path diode Derh biased to the forward and the panel capacitor Cp, and the one electrode of the panel capacitor Cp is charged by the resonance current ir1 owing to the ¼ resonance of the first inductor Lr1 and the panel capacitor Cp. At this time, the current ir1 can not be increased up to maximum value, and the voltage Vp of the panel capacitor Cp can not be increased the voltage Vsus, because the turn-on time of the first switch is shorter than the period of ¼ resonance.

In the period of T2, the first switch Qerh is turned-off, a current path comprising the second diode Dc2, the first inductor Lr1, a charge path diode Derh and the panel capacitor Cp, is formed to sustain the resonance between the panel capacitor Cp and the first inductor Lr1, the voltage Vp across the panel capacitor Cp is increased, and the current ir1 is decreased. At this time, the resonance continues, because the charge path diode Derh is still in the forward state, and the current ir1 decrease because the energy is not supplied from the external capacitor Ce. The voltage Vp of the panel capacitor Cp increases rapidly in the period of T1, however, the voltage Vp is decrease slowly in the period of T2. It depends on the amount of energy stored in the first inductor Lr1 for the period of T1, whether the Voltage Vp of the panel capacitor Cp increase to the voltage Vsus or not.

In the period of T3, the pull-up switch Qh is turned-on to increase the voltage Vp of the panel capacitor Cp to Vsus. At this time, a current path, comprising the second diode Dc2, the first inductor Lr1, the first diode Dc1 and the external capacitor, is formed, at that moment of the turning-off the charge path diode Derh, to recover energy to the external capacitor Ce, if the energy is left in the first inductor Lr1.

In the period of T4, state of each switch is sustained as the period of T3 in order to sustain the voltage Vp of the panel capacitor Cp to the voltage Vsus.

In the period of T5, the pull-up switch Qh of the driving unit 32 is turned-off, the second switch Qerl of the energy recovery unit 30 is turned-on to form a current path comprising, the panel capacitor Cp, the discharge path diode Derl, the second inductor Lr2 and the second switch Qerl, and the voltage of the one electrode of the panel capacitor Cp is discharged by the resonance current ir2 owing to the ¼ resonance of the second inductor Lr2 and the panel capacitor Cp. At this time, the current ir2 can not be increased to maximum value and the voltage Vp of the panel capacitor Cp can not be decreased to the ground voltage, because the turn-on time of the second switch Qerh is shorter than the ¼ resonance of the second inductor Lr2 and the panel capacitor Cp.

In the period of T6, the second switch Qerl is turned-off, and a current path, comprising the discharge path diode Derl, the second inductor Lr2, the third diode Dc3 and the external capacitor Ce, is formed to continue discharging the one electrode of the panel capacitor Cp. At this time, the discharge path Derl is sustained to the forward state in order to sustain the resonance, however the current ir2 is decreased. The voltage Vp of the panel capacitor Cp decreases rapidly in the period of T5, and the voltage Vp is decrease slowly, in the period of T6. In the period of T6, it depends on the amount of energy stored in the second inductor Lr2 for the period of T5, whether the Voltage Vp of the panel capacitor Cp is completely discharged to the ground voltage or not.

In the period of T7, the pull-down switch Ql in the driving unit 32 is turned-on, the voltage Vp of the panel capacitor Cp is decreased to the ground voltage, the discharge path diode Derl is turned-off, and a current path, comprising the fourth diode Dc4, the second inductor Lr2, the third diode Dc3 and the external capacitor Ce, is formed to recover energy to the external capacitor Ce. At this time, the resonant does not generate, and the current ir2 is decreased to 0, rapidly and linearly. Thereafter, state of each switch is sustained in order to sustain the voltage Vp of the panel capacitor Cp to the ground voltage.

A pull-down switch (not shown) of the driving unit in the second sustain driver 400 is turned-on for the periods T1 to T7 in order to form a closed-loop. After the period of T7 is completed in the first sustain driver 300, the periods T1 to T7 are performed in the second sustain driver 400 as the same manner in first sustain driver 300.

As mentioned above, it may be generated that the panel capacitor Cp is not fully charged or discharged, in case of setting up an interval of turn-on of the first switch Qerh and the second switch Qerl shorter than the ¼ resonance cycle of the panel capacitor Cp and inductors Lr1 and Lr2. The waveform of the voltage Vp of the panel capacitor Cp, in FIG. 4C, shows that the capacitor Cp is not fully charged or discharged. However, the capacitor Cp can be fully charged or discharged by delaying turn-on time of the pull-up switch Qh and pull-down switch Ql in the driving unit 32 or by reducing the inductance of the first and second inductors Lr1 and Lr2 in order to decrease the slope of the resonance current without delaying turn-on time of the pull-up switch Qh and pull-down switch Ql.

As mentioned above, the operation of energy recovery is not affected, seriously, whether the turn-on interval of the first and the second switch Qerh and Qerl adjusts to the ¼ resonance cycle of the panel capacitor Cp and inductors Lr1 and Lr2 in the energy recovery unit 30 or dose not adjust to. Moreover, it is possible to reduce the conduction loss of each device in the energy recovery unit by adjusting the turn-on interval of the first and the second switch Qerh and Qerl.

Figure 5:
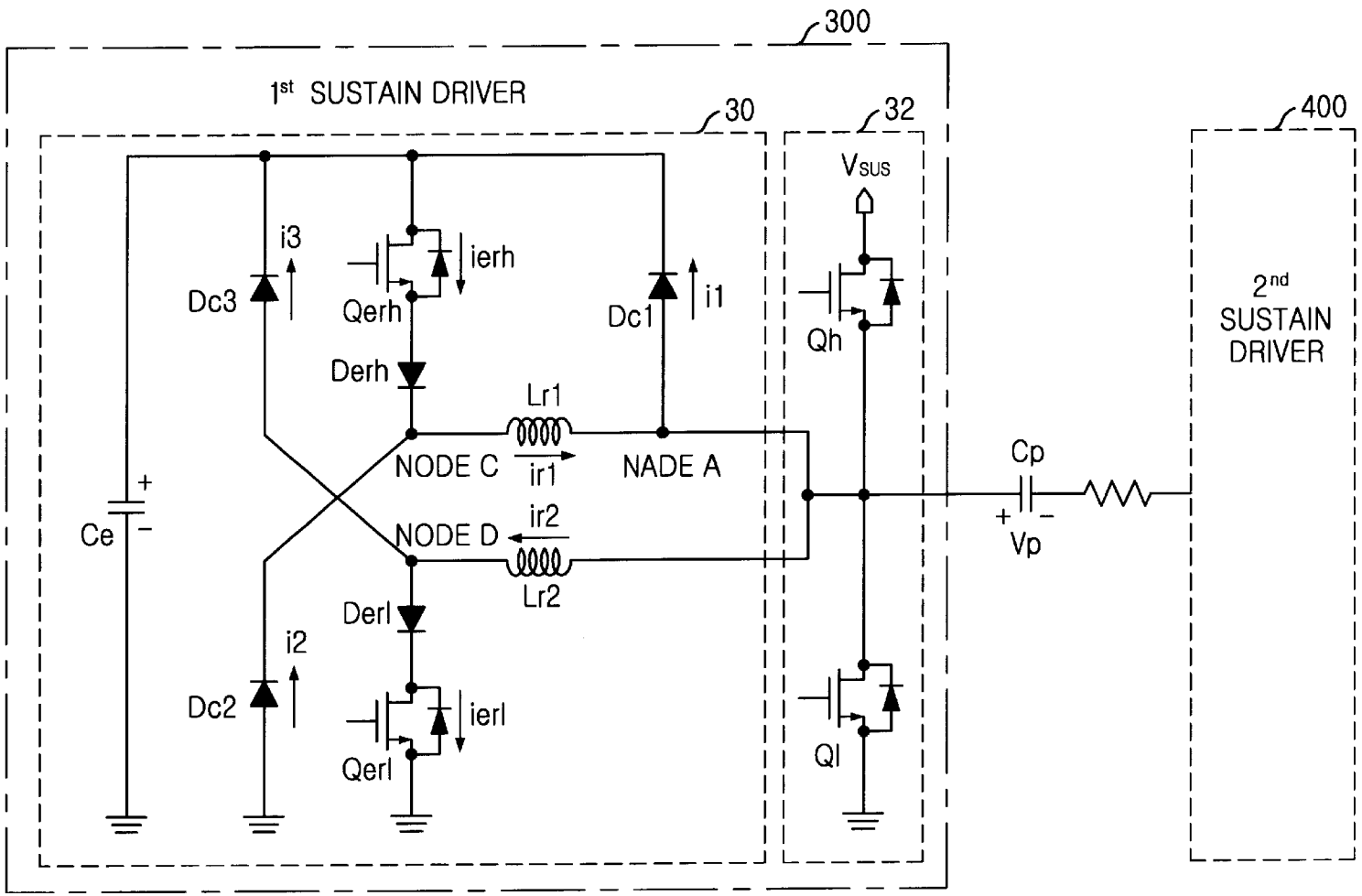
FIG. 5 is a circuit diagram showing sustain drivers of a second plasma display panel (PDP) having an energy recovery unit in accordance with another embodiment of the present invention.

FIG. 5 is a circuit diagram showing sustain drivers in a second PDP having the energy recovery unit in accordance with another embodiment of the present invention.

In the sustain drivers of the second PDP, the charge path diode Derh is connected between the node C and the first switch Qerh, the discharge path diode Derl is connected between the node D and the second switch Qerl, respectively, compared to the sustain drivers of the first PDP shown in FIG. 3. By moving the places of the charge path diode Derh and the discharge path diode, it is possible to remove the fourth diode Dc4 in the sustain driver.

The operation of the second PDP is the same with the first PDP, that is, the waveforms show in FIGS. 4A to 4C can be adopted to the operation of the second PDP.

For example, referring to FIG. 4A, the sustain driver of the second PDP is operated as follows. In the period of T1, the panel capacitor Cp is charged by forming a current path comprising the external capacitor Ce, the first switch Qerh, the charge path diode Derh, the first inductor Lr1 and the panel capacitor Cp. In the period of T2, the energy is recovered to the external capacitor Ce by forming a current path comprising the second diode Dc2, the first inductor Lr1, the first diode Dc1 and the external capacitor Ce. In the period of T4, the panel capacitor Cp is discharged by forming a current path comprising the panel capacitor Cp, the second inductor Lr2, the discharge path diode Derl and the second switch Qerl. In the period of T5, the energy is recovered to the external capacitor Ce by forming a current path comprising the pull-down switch Ql, the second inductor Lr2, the third diode Dc3, and the external capacitor Ce.

As mentioned above, it is possible to prevent the energy recovery efficiency from being lowered and to improve the driving characteristic of the PDP, by inducing a ¼ resonance in the energy recovery circuit.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A plasma display panel (PDP) comprising:

a panel capacitor representing panels of the PDP;

a driving unit for driving the panel capacitor to a sustain voltage and ground voltage; and an energy recovery unit for recovering and supplying energy together with the driving unit, wherein the energy recovery unit includes, a first inductor for forming a ¼ cycle resonance unit with the panel capacitor when the panel capacitor is charged;

a second inductor for forming a ¼ cycle resonance unit with the panel capacitor when the panel capacitor is discharged; and an external capacitor for supplying an energy to the ¼ cycle resonance unit and storing recovered energy.

2. The PDP as recited in claim 1, wherein the energy recovery unit further comprises:

a first switching means for selectively providing a charge path of the panel capacitor or a discharge path of the panel capacitor;

a second switching means for selectively providing an energy supply path between the external capacitor and the first inductor or an energy recovery path between the external capacitor and the second inductor; and a third switching means for preventing the reverse of a resonance current.

3. The PDP as recited in claim 2, wherein the first switching means includes:

a first switch(Qerh) connected to one end of the first inductor and one electrode of the external capacitor of which another electrode is connected to ground; and a second switch(Qerl) connected to one end of the second inductor and to the ground.

4. The PDP as recited in claim 3, wherein the third switching means includes:

a diode(Derh) of which anode is connected to another end of the first inductor and of which cathode is connected to the panel capacitor; and a diode(Derl) of which cathode is connected to another end of the second inductor and of which anode is connected to the panel capacitor.

5. The PDP as recited in claim 4, wherein the second switching means includes:

a diode(Dc1) of which anode is connected to another end of the first inductor and of which cathode is connected to the one electrode of the external capacitor;

a diode(Dc4) of which cathode is connected to another end of the second inductor and of which anode is connected to the ground;

a diode(Dc3) of which anode is connected to another end of the second inductor and of which cathode is connected to the one electrode of the external capacitor; and a diode(Dc2) of which cathode is connected to another end of the first inductor and of which anode is connected to the ground.

6. The PDP as recited in claim 3, wherein the third switching means further includes:

a diode, connected to the first switch in parallel, of which cathode is connected to the one electrode of the external capacitor and of which anode is connected to the one end of the first inductor; and a diode, connected to the second switch in parallel, of which cathode is connected to the one end of the second inductor and of which anode is connected to the ground.

7. The PDP as recited in claim 6, wherein the second switching means further includes:

a diode of which anode is connected to another end of the first inductor and of which cathode is connected to the one electrode of the external capacitor;

a diode of which cathode is connected to one end of the first inductor and of which anode is connected to the ground; and a diode of which anode is connected to one end of the first inductor and of which cathode is connected to the one electrode of the external capacitor.

8. The PDP as recited in claim 5, wherein turn-on time of the first switch and the second switch is substantially same with the ¼ resonance cycle of the panel capacitor and the first and second inductors.

9. The PDP as recited in claim 7, wherein turn-on time of the first switch and the second switch is substantially same with the ¼ resonance cycle of the panel capacitor and the first and second inductors.

10. The PDP as recited in claim 5, wherein turn-on time of the first switch and the second switch is longer than the ¼ resonance cycle of the panel capacitor and the first and second inductors.

11. The PDP as recited in claim 7, wherein turn-on time of the first switch and the second switch is longer than the ¼ resonance cycle of the panel capacitor and the first and second inductors.

12. The PDP as recited in claim 5, wherein turn-on time of the first switch and the second switch is shoter than the ¼ resonance cycle of the panel capacitor and the first and second inductors.

13. The PDP as recited in claim 7, wherein turn-on time of the first switch and the second switch is shoter than the ¼ resonance cycle of the panel capacitor and the first and second inductors.

14. A plasma display panel (PDP) comprising:

a panel capacitor representing panels of the PDP;

a driving unit for driving the panel capacitor to a sustain voltage and ground voltage; and an energy recovery unit for recovering and supplying energy together with the driving unit, wherein the energy recovery unit includes, a first inductor for forming a ¼ cycle resonance unit with the panel capacitor when the panel capacitor is charged;

a second inductor for forming a ¼ cycle resonance unit with the panel capacitor when the panel capacitor is discharged; and an external capacitor for supplying the sustain voltage to the ¼ cycle resonance unit and storing recovered energy.

15. The PDP as recited in claim 14, wherein the energy recovery unit further comprises:

a first switching means for selectively providing a charge path of the panel capacitor or a discharge path of the panel capacitor;

a second switching means for selectively providing an energy supply path between the external capacitor and the first inductor or an energy recovery path between the external capacitor and the second inductor; and a third switching means for preventing the reverse of a resonance current.

16. The PDP as recited in claim 15, wherein the first switching means includes:

a first switch(Qerh) connected to one end of the first inductor and one electrode of the external capacitor of which another electrode is connected to ground; and a second switch(Qerl) connected to one end of the second inductor and to the ground.

17. The PDP as recited in claim 16, wherein the third switching means includes:

a diode(Derh) of which anode is connected to another end of the first inductor and of which cathode is connected to the panel capacitor; and a diode(Derl) of which cathode is connected to another end of the second inductor and of which anode is connected to the panel capacitor.

18. The PDP as recited in claim 17, wherein the second switching means includes:

a diode(Dc1) of which anode is connected to another end of the first inductor and of which cathode is connected to the one electrode of the external capacitor;

a diode(Dc4) of which cathode is connected to another end of the second inductor and of which anode is connected to the ground;

a diode(Dc3) of which anode is connected to another end of the second inductor and of which cathode is connected to the one electrode of the external capacitor; and a diode(Dc2) of which cathode is connected to another end of the first inductor and of which anode is connected to the ground.

19. The PDP as recited in claim 16, wherein the third switching means further includes:

a diode, connected to the first switch in parallel, of which cathode is connected to the one electrode of the external capacitor and of which anode is connected to the one end of the first inductor; and a diode, connected to the second switch in parallel, of which cathode is connected to the one end of the second inductor and of which anode is connected to the ground.

20. The PDP as recited in claim 19, wherein the second switching means further includes:

a diode of which anode is connected to another end of the first inductor and of which cathode is connected to the one electrode of the external capacitor;

a diode of which cathode is connected to one end of the first inductor and of which anode is connected to the ground; and a diode of which anode is connected to one end of the first inductor and of which cathode is connected to the one electrode of the external capacitor.

* * * * *